US005145328A

United States Patent [19]

Harwath

[11] Patent Number: 5,145,328

[45] Date of Patent: Sep. 8, 1992

[54] FUEL SUPPLY UNIT FOR AN OIL BURNER

[75] Inventor: Frank L. Harwath, Rockford, Ill.

[73] Assignee: Suntec Industries Incorporated, Rockford, Ill.

[21] Appl. No.: 774,845

[22] Filed: Oct. 11, 1991

[51] Int. Cl.[5] ..... F04B 49/02

[52] U.S. Cl. ..... 417/299; 137/117; 137/569; 417/366

[58] Field of Search ..... 417/299, 366; 184/6.25; 137/117, 569

[56] References Cited

U.S. PATENT DOCUMENTS

| | | | |
|---|---|---|---|
| 2,307,954 | 1/1943 | Radke | 184/6.25 X |
| 2,659,425 | 11/1953 | Ifield | 137/117 |
| 3,402,733 | 9/1968 | McAluay | 137/569 X |
| 3,446,231 | 5/1969 | Magnusson | 137/117 X |
| 3,566,901 | 3/1971 | Swedberg | 137/87 |
| 4,021,155 | 5/1977 | Erikson et al. | 417/302 |
| 4,708,156 | 11/1987 | Knudsen | 137/117 |
| 4,813,294 | 3/1989 | Ukai et al. | 184/6.25 X |

*Primary Examiner*—Stephen M. Hepperle

*Attorney, Agent, or Firm*—Leydig, Voit & Mayer

[57] ABSTRACT

A gear pump receives fuel oil from an intake line leading from a storage tank and supplies pressurized fuel to a regulating valve which selectively opens and closes to control the flow of fuel to an oil burner. When the pump first starts but before the regulating valve opens, fuel bypasses the regulating valve and is returned to the tank along with any air that might be in the system, the system thus being automatically purged of air. After the regulating valve opens, excess fuel which is not required by the oil burner is returned directly to the inlet of the pump for recirculation and bypasses both the seal chamber of the pump and the storage tank so as to enable low flow velocity to be maintained in the intake line leading from the tank to the pump and thereby prevent cavitation at the pump when the fuel is of high viscosity. Only a small flow of fuel is directed to the seal chamber to lubricate the shaft of the pump. A magnetic ring in the seal chamber removes metallic components from the fuel in the seal chamber by magnetic attraction and also acts as a baffle to reduce excessive wear of the shaft.

3 Claims, 1 Drawing Sheet

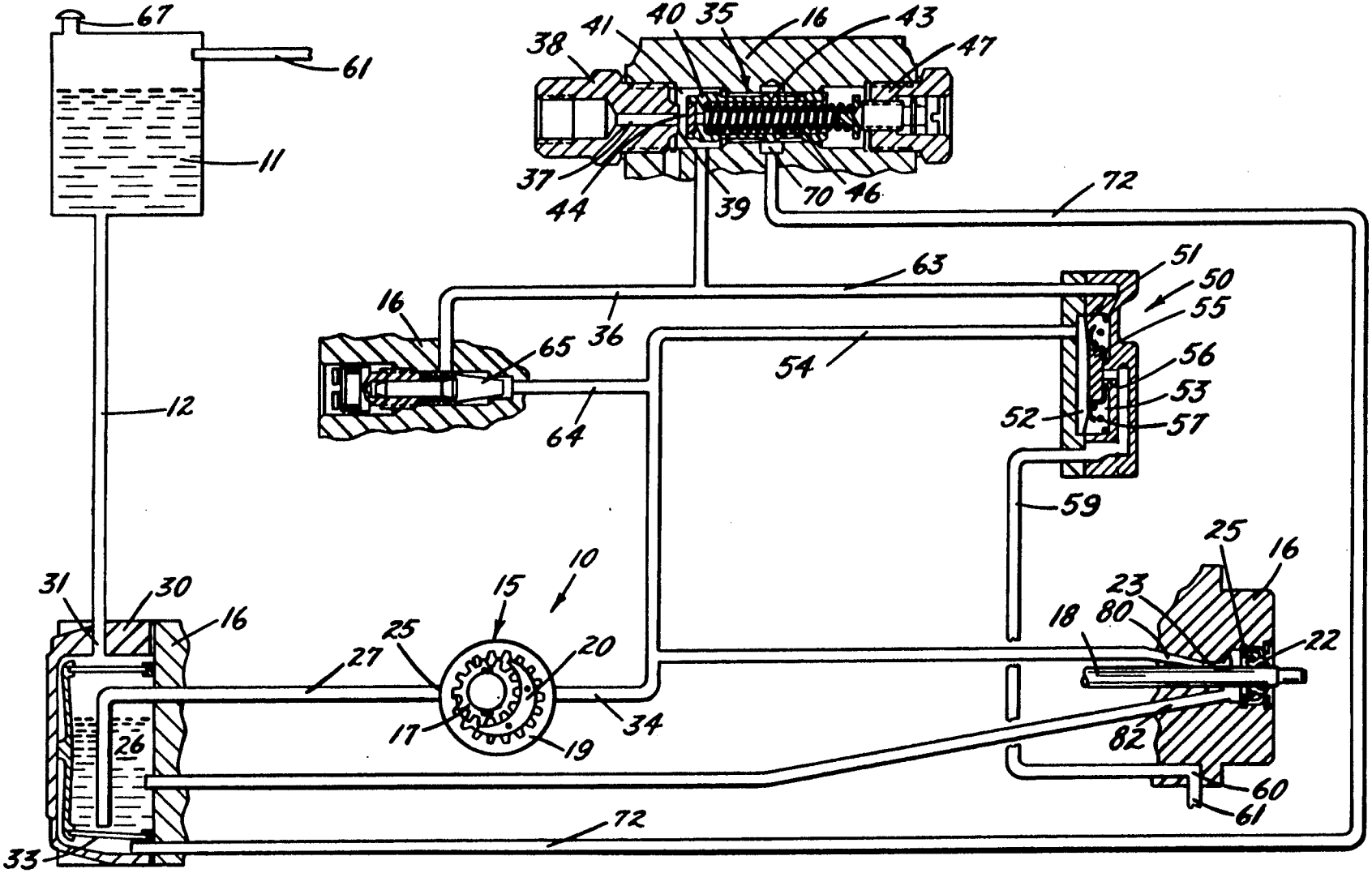
72
47
43
16
35
40
41
38
37
44
46
70
39
63
36
65
16
51
50
55
56
53
57
52
59
54
64
10
15
20
19
17
25
27
34
22
16
25
23
80
18
60
61
82
72
61
67
11
12
16
30
31
26
33

FUEL SUPPLY UNIT FOR AN OIL BURNER

BACKGROUND OF THE INVENTION

This invention relates generally to a fuel burner pumping system having provision for automatically purging air from the system. More particularly, the invention is especially adapted for use in a pumping system which uses fuel in the form of heavily contaminated waste oil of comparatively high viscosity.

The pumping system of the invention is a so-called two-pipe system, meaning that one pipe (an intake pipe) leads from a fuel supply tank to the pump of the pumping system to deliver fuel from the tank to the pump while a second pipe serves as a return pipe to the tank. In prior two-pipe systems, excess fuel oil which is not required by the burner passes through a seal chamber in the pump and is returned to the tank via the second pipe. Any air which is in the system at start-up passes from the seal chamber to the tank with the excess oil and is automatically bled from the system at the tank. A seal is located in the seal chamber and establishes a seal around the shaft of the pump.

Two-pipe systems of the type described above present special problems when the fuel being pumped is waste oil. Because such oil is of high viscosity, it is necessary to maintain a low velocity flow in the intake line between the tank and the pump in order to prevent cavitation at the pump. When a large flow of excess oil is returned to the tank by way of the second pipe, the flow from the tank back to the pump also is large and this creates a relatively high velocity in the intake line. If relatively large quantities of heavily contaminated waste oil pass through the seal chamber of the pump, the seal of the pump may experience only a limited life and the shaft of the pump may experience excessive wear.

SUMMARY OF THE INVENTION

The general aim of the present invention is to provide a new and improved waste oil pumping system which, while being a two-pipe system and capable of automatically purging air via the return pipe and the tank, maintains a relatively low velocity flow in the intake line and protects the seal and the shaft from large quantities of contaminated oil.

A more detailed object of the invention is to provide a two-pipe system in which the return pipe is used to bleed air from the system during start-up while, after start-up, excess oil bypasses both the seal chamber and the tank so as to reduce wear of the seal and the shaft and to allow low flow velocities to be maintained in the intake line.

A related object of the invention is to provide a self-purging, two-pipe system in which excess oil resulting during steady state operation is returned directly to the pump without passing through the seal chamber, the return pipe or the tank.

The invention also resides in the unique provision of a baffle in the form of a magnetic ring adjacent the seal to extract metallic contaminants from the waste oil and reduce wear otherwise resulting from such contaminants.

These and other objects and advantages of the invention will become more apparent from the following detailed description when taken in conjunction with the accompanying drawings.

BRIEF DESCRIPTION OF THE DRAWINGS

The single FIGURE of the drawing is a schematic representation of a new and improved oil pumping system incorporating the unique features of the present invention.

DETAILED DESCRIPTION OF THE PREFERRED EMBODIMENT

As shown in the drawings for purposes of illustration, the invention is embodied in a fuel pumping system 10 of the type used to supply fuel oil to an oil burner (not shown) such as might be incorporated in a furnace or boiler. Fuel oil from a source such as a tank 11 is drawn therefrom through an intake line 12 by a pump 15, is pressurized and is delivered by the pump to the oil burner. The tank may be located a considerable distance from the pump and thus the intake line 12 may be relatively long.

The pump 15 includes a body or housing 16 and is of the crescent gear type. An inner gear 17 within the housing is attached to a drive shaft 18 and is eccentrically disposed with respect to an outer gear 19. A crescent-shaped member 20 is disposed between the nonengaging portions of the teeth on the gears for the purpose of sealing the expanding fluid chambers defined by the gears from the contracting fluid chambers in a well known manner.

The shaft 18 is journaled in the housing 16 and is sealed with respect thereto by an elastomeric sealing member which herein is in the form of a lip seal 22. The lip seal is disposed within and closes off a chamber 23 in the housing 16.

An inlet 25 of the pump 15 communicates with a reservoir 26 by means of a passage 27 in the housing 16. The reservoir is defined by an end cover 30 bolted to one end of the housing and having an intake port 31 to which the intake line 12 is connected. A suitable strainer 33 located within the reservoir 26 between the intake port 31 and the pump inlet 25 serves to filter the fuel as it is drawn from the tank to the pump 15. Upon exiting the pump, the fuel flows through an outlet passage 34 and ultimately is delivered to a main regulating valve assembly 35 which serves to regulate the pressure of the fuel and cause fuel flowing to the oil burner to be of substantially constant pressure.

Herein, the regulating valve assembly 35 is located in the housing 16 and serves to control the flow of fuel from a fuel supply passage 36 to a nozzle passage 37 which leads to the fuel burner. The nozzle passage 37 is formed in a fitting 38 threaded into the housing and having a projection which defines a valve seat 39 adapted to be closed by a hollow valve member 40. The latter is mounted slidably in a pressure chamber 41 communicating with the fuel supply passage 36, there being a land 43 on the valve member between the ends thereof. A disc 44 is seated within a recess in the forward end of the valve member and is adapted to engage the valve seat 39 to close the nozzle passage 37.

In operation, pressurized fuel entering the pressure chamber 41 from the passage 36 moves the valve member 40 to the right against the closing force of a coil compression spring 46 seated within the hollow portion of the valve member and reacting against a normally stationary but adjustable spring seat 47. When the pressure in the chamber is sufficient to overcome the closing force of the spring, the valve member moves to the right to permit fuel to flow into the nozzle passage 37.

A diaphragm valve 50 causes the pump 15 to reach a high start-up r.p.m. before the valve member 40 opens and causes the valve member to close after the pump falls below a high r.p.m. upon shutdown. Herein, the diaphragm valve includes a resilient diaphragm 51 located within a chamber and dividing the chamber into two compartments 52 and 53. The compartment 52 communicates with the outlet 34 of the pump via a passage 54 in the housing 16. A valve member 55 is located in the other compartment 53, is carried by the diaphragm 51 and is urged away from a control port 56 by a spring 57. The control port 56 is connected to a passage 59 which, in turn, leads to a return port 60 in the housing 16, the return port communicating with the tank 11 by way of a return line 61.

An additional passage 63 establishes communication between the supply passage 36 and the compartment 53 of the diaphragm valve 50. Pressurized fluid from the outlet 34 of the pump 15 flows to the supply passage 36 by way of a passage 64 and an adjustable cone valve 65.

With the foregoing arrangement, the spring 57 normally holds the valve member 55 of the diaphragm valve 50 in an open position with respect to the control port 56. When the pump 15 is started, fuel from the outlet 34 is supplied to the compartment 52 of the valve 50 through the passage 54, is delivered to the supply passage 36 via the passage 64 and the cone valve 65, and is supplied to the compartment 53 of the valve 50 by way of the passage 63. During start-up when the pump is at relatively low speed, the flow past the cone valve is relatively low and thus the differential between the pressure in the compartment 52 and the pressure in the compartment 53 is not sufficiently great to overcome the spring 57 and close the valve member 55 with respect to the control port 56. As a result, fuel delivered to the compartment 53 from the passage 63 flows through the control port 56 and returns to the tank 61 by way of the passage 59, the return port 60 and the return line 61. Any air which might be in the system is purged therefrom by flowing through a slot in the cone valve 65 and then through the diaphragm valve 50 and the return line 61 to the tank 11, the latter being vented to atmosphere as indicated schematically at 67. Thus, the system is automatically purged of air when the pump starts.

As long as the speed of the pump 15 is relatively low, the valve member 55 of the diaphragm valve 50 remains open and prevents a build up of pressure in the chamber 41 of the regulating valve 35 so that the valve member 40 stays closed. As the pump speed increases, however, the increased flow past the cone valve 65 causes the pressure differential between the compartments 52 and 53 to increase sufficiently that the pressure in the compartment 52 overcomes the force of the spring 57 and closes the valve member 55 against the control port 56. With the control port closed, the pressure in the chamber 41 rises rapidly and such pressure opens the valve member 40 against the force of the spring 46 so as to allow fuel to flow from the supply passage 36 to the nozzle passage 37. In this way, the valve member 40 opens rapidly in response to pump speed and flow. When the pump shuts down, the valve member 55 of the diaphragm valve 50 opens after the pump drops below full speed. Opening of the valve member 55 quickly reduces the pressure in the chamber 41 to enable the valve member 40 to rapidly close. Reference is made to Swedberg U.S. Pat. No. 3,566,901 for a more complete disclosure of the operation of a diaphragm valve of the same general type as the valve 50.

Only a portion of the fuel from the supply passage 36 flows through the nozzle passage 37 during operation of the pump 15. The remaining fuel bypasses the nozzle passage and exits the pressure chamber through a bypass port 70. In normal operation, the pressure in the chamber 41 is sufficiently high to move the valve member 40 to the right to such an extent that the land 43 uncovers the bypass port 70 to allow fuel to flow continuously to that port.

In carrying out the invention, fuel discharged from the bypass port 70 is returned directly to the reservoir 26 in the pump cover 30 and does not pass through the seal chamber 23 for return to the tank 11. For this purpose, the bypass port 70 is connected directly to the reservoir 26 by a passage 72 in the housing 16. Thus, excess fuel oil which does not flow through the nozzle passage 37 is returned directly to the reservoir 26 via the bypass port 70 and the passage 72 for recirculation through the pump 15. In this instance, the passage 72 communicates with the reservoir 26 outside of the strainer 33 and thus the excess fuel oil is filtered before being recirculated.

With the foregoing arrangement, fuel oil is returned to the tank 11 via the return port 60 and the return line 61 only for short periods of time when the valve member 55 of the diaphragm valve 50 is open and there is flow through the control port 56 and the passage 59 during start-up and shutdown of the pump 15. During start-up, air is purged automatically from the system by virtue of bleeding through the diaphragm valve and being driven to the tank by the pressurized fuel. Air is purged from the system regardless of whether the tank 11 is located above or below the pump 15.

During normal operation of the pump 15 after closing of the valve member 55 of the diaphragm valve 50, excess oil from the bypass port 70 is returned directly to the reservoir 26 via the internal passage 72 for recirculation through the pump. Since the excess fuel is not returned to the tank during steady state operation, the velocity of flow in the long intake line 12 to the pump is kept relatively low to reduce line losses resulting from friction. As a result, the pump may function with high viscosity fuel such as waste oil without experiencing cavitation.

The system described above also enables the use of contaminated fuel such as waste oil without producing excessive deterioration of the lip seal, 22 and excessive wear of the pump shaft 18. Since excess oil from the bypass port 70 is returned directly to the reservoir 26 and does not pass through the seal chamber 23, the shaft 18 and the seal 22 are not subjected to a high volume flow of oil containing metallic grit and the like. Some oil does flow through the seal chamber 23 for purposes of lubricating the shaft 18 but the volume of the lube oil flow is low when compared to a system in which all of the excess oil from the bypass port 70 is returned through the seal chamber. Lube oil flows to the seal chamber 23 from the outlet 34 of the pump through a slot 80 in the housing 16 and returns to the reservoir 26 via a passage 82 in the housing. Herein, the passage 82 leads directly to the reservoir 26 and without effecting flow of the return lube oil through the strainer 33.

Advantageously, metallic contamination in the flow of lube oil to the seal chamber 23 is removed therefrom by a magnetic ring 85 which is positioned in the seal chamber just ahead of the lip seal 22. Magnetic particles in the oil are attracted to the magnet so as to further reduce wear of the shaft 18 and the seal 22. The magnetic ring also acts as a baffle or barrier in front of the seal so as to protect the seal from particles.

From the foregoing, it will be apparent that the present invention brings to the art a new and improved two-pipe fuel burner pumping system 10 in which fuel is returned to the tank 11 only during start-up and shutdown of the pump 15, the return during start-up being advantageous in that it effects automatic purging of air from the system. During steady state operation of the pump, excess oil from the bypass port 70 is not directed to the tank but instead is returned directly to the reservoir 26 in the pump cover 30. Such direct return reduces the velocity of flow in the intake line 12 from the tank to the pump and allows the system to operate with waste oil or other oil of high viscosity without causing cavitation at the pump. Because there is only a small volume of flow through the seal chamber 23, the lip seal 22 is subjected to only a small quantity of contaminated oil and thus experiences a longer life. Moreover, the magnetic ring 85 attracts metallic particles in the seal chamber and acts as a baffle in order to further help increase the life of the lip seal.

I claim:

1. A fuel supply unit for an oil burner and comprising a pump having an intake line adapted to communicate with a fuel storage tank, said pump having a reservoir for receiving fuel from said intake line, said pump having fuel supply passage means and being operable to pressurize fuel from said reservoir and to deliver pressurized fuel to said supply passage means, burner passage means, a main regulating valve normally closing said burner passage means and operable when opened to permit fuel to flow from said supply passage means to said burner passage means, said regulating valve being opened automatically when the flow in said supply passage means reaches a predetermined value, control valve means responsive to flow in said supply passage means and operable to vent fuel and air from said supply passage means until the flow in said supply passage means reaches a predetermined value, means communicating with said control valve means and operable to return fluid vented from said supply passage means to the tank, and bypass passage means adapted to communicate with said supply passage means and operable, when said regulating valve is open, to receive excess fuel from said supply passage means, said bypass passage means communicating with said reservoir downstream of said intake line whereby excess fuel is returned directly to said reservoir without passing through the tank.

2. A fuel supply unit as defined in claim 1 in which said pump further includes a housing, a shaft rotatably supported by said housing, a chamber formed in said housing and receiving a portion of said shaft, a seal in said chamber and sealing against said shaft, passage means for delivering fuel from said reservoir into said chamber and for returning such fuel from said chamber to said reservoir, said bypass passage means being out of communication with said chamber whereby none of said excess fuel is directed into said chamber.

3. A fuel supply unit as defined in claim 2 further including an annular magnet disposed in said chamber and encircling said shaft with radial clearance, said magnet attracting magnetic particles in the fuel delivered to said chamber.

* * * * *